United States Patent [19]

Alsup

[11] Patent Number: 4,872,566

[45] Date of Patent: Oct. 10, 1989

[54] TACO SHELL HOLDER

[76] Inventor: Richard E. Alsup, 2104 Loma Vista Pl., Los Angeles, Calif. 90039

[21] Appl. No.: 196,445

[22] Filed: May 20, 1988

[51] Int. Cl.[4] ..... A47F 7/00

[52] U.S. Cl. ..... 211/13; 248/174; D7/76

[58] Field of Search ..... 248/174, 300, 152; 211/13, 11, 10; D7/76, 72

[56] References Cited

U.S. PATENT DOCUMENTS

| | | | |
|---|---|---|---|
| D. 237,020 | 9/1975 | Valentine | D7/76 X |
| D. 273,746 | 5/1984 | Hunt | D7/76 |
| D. 278,199 | 4/1985 | Richards | D7/76 |
| D. 282,338 | 1/1986 | Putt | D7/76 |
| D. 296,063 | 6/1988 | Morrison et al. | D7/72 |
| 2,709,494 | 5/1955 | Luce | 180/68.5 |
| 2,833,363 | 5/1958 | Henehan | 248/503 Y |
| 3,478,892 | 11/1969 | Lockwood | 211/126 |
| 3,730,464 | 5/1973 | Kelly | 248/300 Y |
| 3,915,309 | 10/1975 | Brazdo | 211/13 |
| 3,972,169 | 8/1976 | Sheppard, Jr. | 248/300 Y |
| 4,270,660 | 6/1981 | Putt | 211/13 |
| 4,603,825 | 8/1986 | Kotliar | 248/174 |
| 4,653,645 | 3/1987 | Thomas | 248/174 X |
| 4,709,897 | 12/1987 | Mooney | 248/300 Y |

OTHER PUBLICATIONS

John Deere, Operators Manual "Series TB-92-N power unit", 1-1959, p. 27.

*Primary Examiner*—Alvin C. Chin-Shue
*Attorney, Agent, or Firm*—Milton S. Gerstein

[57] ABSTRACT

A taco shell holder has a bottom support surface from which project a pair of oppositely-disposed side walls diverging away from each other. Each side wall is in the shape of a trapezoid and defines an upper edge sloping downwardly from front to rear to accomodate partially-eaten taco shells. A pair of oppositely-disposed, triangular brace walls are provided forwardly to allow the holder to be self-supporting.

3 Claims, 1 Drawing Sheet

TACO SHELL HOLDER

BACKGROUNS OF THE INVENTION

The present invention is directed to a holder for a taco shell. Prior art taco shell holders are known, in which such holders are used for holding a taco shell during the consumption thereof as well as during the filling of the shell with contents. The present invention is an improvement over these prior-art taco shell holders.

SUMMARY OF THE INVENTION

It is the primary objective of the present invention to provide a taco shell holder which holds a taco shell during the filling thereof with contents and during the actual consumption thereof, which taco shell holder provides a greater degree of facility to the consumer during consumption of the taco shell.

It is another objective of the present invention to provide a taco shell holder that is self-supporting and allows for the holder and retained taco shell to be self-supporting on a surface.

It is yet another objective of the present invention to provide a taco shell holder that allows for easy stacking of a plurality of such taco shell holders for storage and shipping.

Toward these and other ends, the taco shell holder of the present invention is relatively considerably smaller than a taco shell to be held and stored. The holder is preferably made of plastic and includes a main body section having a flat, bottom surface upon which rests the taco shell. Projecting upwardly from the two longitudinal side edges of the bottom surface are a pair of upstanding, outwardly sloping side walls. The two side walls diverge away from each other and each side wall diverges outwardly away from a vertical plane containing therein the respective longitudinal side edge, so that a plurality of such taco shell holders may be stacked together for storage or shipping, as well as to allow for the filling of the taco shell in an attractive manner. Each of the two side walls also has an downwardly sloping upper edge surface, so that each side wall is formed in the shape of a trapezoid, with there being a longer vertical side edge or base and a shorter vertical side edge or base. This allows not only for a more easy removal of the top-most one of stacked taco shell holders, but more importantly allows the taco shell holder to be used during all stages of consumption by the person consuming the taco shell, in that a partially-eaten taco shell, having, or course, a reduced height as compared with its original size, may be grasped by the fingers of the hand, since at least one upper portion thereof will project upwardly beyond a portion of the downwardly-sloping upper edge surface of a respective side wall. Projecting from the longer vertical side edge of each of the side walls is a triangular-shaped brace-wall that extends at an angle with respect to the plane containing therein the respective side wall associated therewith. These brace-walls serve to support the holder in a self-standing manner, so that during the filling of the taco shell with its contents, both hands of the person are free, obviating the need to have one hand hold the holder upright during such filling process.

BRIEF DESCRIPTION OF THE DRAWING

The invention will be more readily understood with reference to the accompanying drawing, wherein.

DETAILED DESCRIPTION OF THE INVENTION

Figure 1:
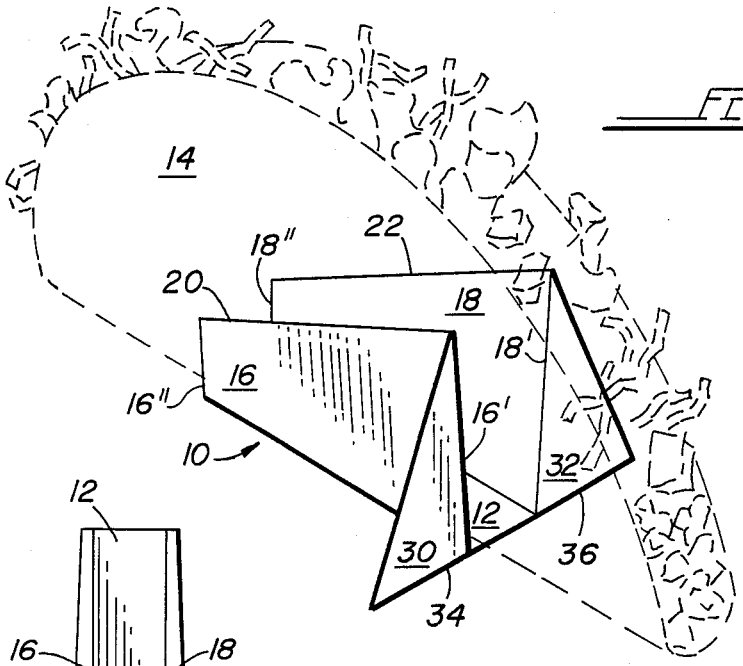
FIG. 1 is an isometric view showing the taco shell holder of the present invention.
Figure 2:
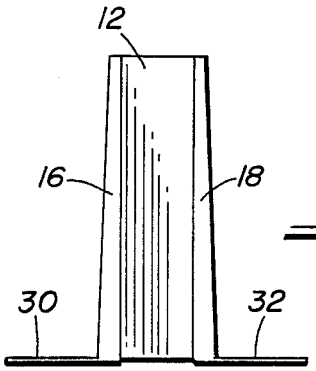
FIG. 2 is a top view thereof.
Figure 3:
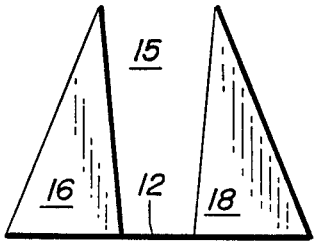
FIG. 3 is a front view thereof.
Figure 4:
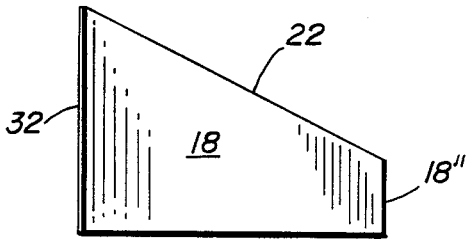
FIG. 4 is a side view thereof.
Figure 5:
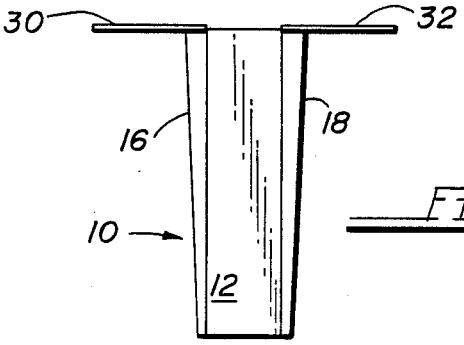
FIG. 5 is a bottom view thereof.

Referring now to the drawing in greater detail, the taco shell holder of the present invention is indicated generally by reference numeral 10 in the drawing. The taco shell holder 10 is preferably made of plastic, and has a bottom or lower flat support surface 12, which in the preferred embodiment is rectangular in shape, with a length of approximately two inches and a width of approximately ½ inch. A taco shell 14 is supported on this bottom surface, as shown in FIG. 1. Projecting upwardly from each of the long side edges of the rectangularly-shaped bottom surface 12 is a side wall 16, 18. Each side wall 16, 18 preferably has a trapezoidal shape, as clearly shown in FIGS. 1 and 4. This shape is defined by a front or forward base or edge surface 16′, 18′, respectively, and a rear or back base or edge surface 16″, 18″, respectively, the rear base or edge surface being shorter than the front or forward bases. In the preferred embodiment, each rear base 16″, 18″ has a height or length of 1/2 inch, while each front or forward base 16′, 18′ has a height or length of 1½ inches, which thereby define a forwardly and upwardly sloping upper edge surface 20,22, respectively. to form an acute angle of 27 degrees with the horizontal. Each of the side walls 16, 18 also slopes outwardly away from the interior 15 of the holder 10, as best seen in FIG. 2,3 and 5. The angle each side wall 16, 18 makes with the vertical is a small acute angle, preferably in the range of between 10 and 30 degrees. Such outward or exterior sloping of the side walls allows for a plurality of such taco shell holders 10 to be stacked one on top another, and also allows for a more attractive as well as easier filling of the taco shell with its contents, since the upper edge surfaces 20, 22 are spaced farther apart from each other than the lower base edge surfaces of the side walls. In the preferred embodiment, the lower base edge surfaces of the side walls are spaced apart one-half inch, which, of course, is the width of the bottom surface 12. The upper edge surfaces 20, 22 are spaced apart in the horizontal direction a distance of two inches. Thus, the slope of each side wall with respect to the vertical is 30 degrees. The trapezoidal shape of the side walls 16, 18, with the concomitant sloping upper edges 20, 22 provides a dual function. Firstly, it allows for easier removal of the uppermost taco shell holder from a stack of taco shell holders 10, which stacking, as described above, is facilitated by the outwardly sloping side walls 16, 18. Secondly, and more importantly, the sloping upper edges 20, 22 define vertical wall surfaces on either side of the cavity 15 that decline in height from front toward rear. This allows the taco shell holder 10 to be used by the consumer to hold the partially eaten taco shell, which partially eaten taco shell naturally has a reduced relative height as compared with the taco shell 14. Thus, as the height of the consumed taco shell diminishes, an upper portion of this partially-eaten taco shell will still project upwardly beyond a rearward portion of the upper edges 20, 22, to allow for the fingers to grasp such upper portion to remove the taco shell, if desired, or to allow this upper portion of the taco shell projecting beyond this rearward portion of the upper edges 20, 22 to be eaten without hindrance. The taco shell may be moved rearwardly so as to expose a new, more-forwardly, upper portion of the partially-eaten taco shell above the rearward portions of the upper edges 20, 22, so that most of the taco shell may be eaten in this manner without having to remove it from the holder 10 until only a small portion of the shell remains. A typical taco shell has a diameter of five inches, so that in the preferred embodiment, the taco shell extends beyond each end of the holder approximately 1½ inches when centered and uneaten. The height of the typical shell is 2½ inches, so that it projects upwardly beyond the bases 16', 18' approximately ½ inch, and above the bases 16'', 18'' two inches.

Each side wall 16, 18 is also provided with a transversely-extending brace wall 30, 32 respectively. Each brace wall is substantially triangular in shape, and has a vertical edge common with the vertical edges or bases 16', 18'. Each brace wall also has a lower, horizontal edge 34, 36, respectively, which supports each brace wall on a flat surface therebelow, so that the entire taco shell holder 10 is made self-supporting, so that the taco shell 14 may be filled without the need of one hand holding the holder upright during such filling process, so that both hands are free. Each brace wall in the preferred embodiment forms an acute triangle, but it is to be understood that when the side walls 16, 18 are not made to slope outwardly but to extend perpendicuarly to the edges of the base wall 12, each brace wall will be a right-angle triangle. In the preferred embodiment, the lower edges 34, 36 are approximately 3/4 inches in length. This provides a total width at the forward portion of the holder 10 of approximately two inches including the ½ inch width of the base wall 12. It is, of course, to be understood that dimensions above-stated are only by way of example, and given only as the best-mode contemplated. Other dimensions may be utilized and fall within the scope and intent of the present invention. The brace walls also have the additional function of allowing use of the holders 10 as building blocks or units, allowing a child the ability to stack them, arrange them in any desired pattern, and build with them a desired structure, in combination with the other flat surfaces of the taco shell holder 10. The stacking capabilities of the holders 10 also permit them to be used for easy dispensing in restaurants, fast-food chains, and the like. The preferred material is hard plastic, such as polypropylene, and the like, though other materials may be used as long as they fall within the spirit of the invention.

While a specific embodiment of the invention has been shown and described, it is to be understood that numerous changes and modifications may be made therein without departing from the scope and spirit of the invention as set forth in the appended claims. For example, the side walls 16, 18 may be perpendicular to the longitudinal edges of the base 12, so that these side walls do not slope outwardly.

What I claim is:

1. In a taco shell holder for holding a taco shell during the filling thereof and during consumption, said taco shell holder comprising:

a bottom horizontal support surface upon which rests a lower surface of a taco shell, said bottom support surface comprising a first and a second parallel longitudinal edge, a forward edge and a rearward edge;

a first and second upstanding side wall, said first side wall having a lower edge integral with said first longitudinal edge of said bottom support surface and projecting upwardly therefrom, and said second side wall also having a lower edge integral with said second longitudinal edge of said bottom support surface and projecting upwardly therefrom:

each of said first and second side walls having an upstanding forward edge surface substantially adjacent said forward edge of said bottom support surface, each said side wall further comprising an upper edge surface sloping downwardly from said forward edge rearwardly, whereby the vertical distance of each said upper edge above said bottom support surface continuously diminishes from front toward rear; a first and a second triangular brace wall, said first brace wall having an upstanding edge integral with the entire height of the forward edge surface of said first side wall, and said second brace wall having an upstanding edge integral with the entire height of the forward edge surface of said second side wall, said first brace wall lying in a plane extending at an angle with respect to a plane containing therein said first side wall, and said second brace wall lying in a plane extending at an angle with respect to a plane containing therein said second side wall, whereby said brace walls serve to hold the holder erect in self-supporting manner, so that a taco shell is held therein during the filling process without the need of support by a hand;

each said side wall extending along the entire length of said bottom support surface and being trapezoidal in shape and also comprising a rear edge surface parallel to said forward edge surface, said rear edge surface having a height less than said forward edge surface, said rear and forward edge surfaces defining the bases of said trapezoidal shape, each said first and second side wall extending upwardly from the respective said longitudinal edge of said bottom surface and diverging away from each other, each said side wall lying in a plane forming an acute angle with respect to a vertical plane containing therein a respective said longitudinal edge of said bottom support surface, said acute angle being between ten and thirty degrees;

each said upper edge surface of each said side wall sloping downwardly at an angle of between fifteen and forty degrees;

each said brace wall extending from said upstanding forward edge of a respective said side wall.

2. The taco shell holder according claim 1, wherein said forward edge of said bottom support surface is one-half inch in length, and each said longitudinal edge is two inches in length.

3. The taco shell holder according to claim 2, wherein each said upstanding edge of each said side wall is one and one-half inches in height, each said rear edge of each said side wall being one-half inch in height.

* * * * *